US005218977A

United States Patent [19]

Takahashi

[11] Patent Number: 5,218,977

[45] Date of Patent: Jun. 15, 1993

[54] WIG-LIKE COOL CAP AND METHOD FOR MANUFACTURING

[76] Inventor: Masakatsu Takahashi, 4-6, Narihira-cho, Ashiya-shi, Hyogo 659, Japan

[21] Appl. No.: 768,679

[22] PCT Filed: Feb. 26, 1990

[86] PCT No.: PCT/JP90/00229

§ 371 Date: Oct. 17, 1991

§ 102(e) Date: Oct. 17, 1991

[87] PCT Pub. No.: WO91/12739

PCT Pub. Date: Sep. 5, 1991

[51] Int. Cl.[5] ..... A41G 5/00

[52] U.S. Cl. ..... 132/54; 132/53; 132/56; 132/201

[58] Field of Search ..... 132/53, 54, 56, 201; 623/15

[56] References Cited

U.S. PATENT DOCUMENTS

| | | | |
|---|---|---|---|
| 3,520,309 | 7/1970 | Lane et al. | 132/53 |
| 3,665,940 | 5/1972 | Schordalides et al. | 132/53 |
| 3,786,822 | 1/1974 | Kimura et al. | 132/53 |
| 3,970,092 | 7/1976 | Nelson | 132/53 |
| 4,799,502 | 1/1989 | Kobayashi et al. | 132/53 |
| 5,005,596 | 4/1991 | Yamada | 132/53 |

FOREIGN PATENT DOCUMENTS

| | | | |
|---|---|---|---|
| 0248559 | 12/1987 | European Pat. Off. | 132/201 |
| 48-10817 | 4/1973 | Japan . | |
| 58-104204 | 6/1983 | Japan . | |
| 62-51132 | 3/1987 | Japan . | |

*Primary Examiner*—Gene Mancene
*Assistant Examiner*—Frank A. LaViola
*Attorney, Agent, or Firm*—Armstrong, Westerman, Hattori, McLeland & Naughton

[57] ABSTRACT

A wig-like cool cap wherein an artificial hair is implanted to an artificial scalp portion. The artificial hair is composed of carbon fiber or fine thread form comprising twisted plural carbon fibers, while the artificial scalp portion comprises a central network portion (1) and an outer surrounding membranous portion (2). The central network portion (1) is composed of carbon fiber or fine thread form comprising twisted plural carbon fibers and is constructed in a network. The outer surrounding membranous portion (2) is arranged at an outer circumference of the central network portion and has a plurality of micropores. Because carbon fiber has very large coefficient of thermal conductivity and is superior in heat-releasing characteristic, it can prevent stuffiness and sweat peculiar to conventional wigs. Further, because carbon fiber is superior in resistance against chemicals, hair care products, coloring reagent and the like can be freely used. A cap of the present invention is manufactured in a manner that an artificial hair is penetrated through a sieve plate (4) and perforated frame (5) to be brought into contact with an artificial scalp portion (6), and thereafter the artificial hair is fixed.

7 Claims, 4 Drawing Sheets

WIG-LIKE COOL CAP AND METHOD FOR MANUFACTURING

TECHNICAL FIELD

The present invention relates to a wig-like cool cap which is used indoors and outdoors and a method for manufacturing the same. In particular, the present invention relates to a wig-like cool cap including a hair wig and a hairpiece, in which artificial hair made from carbon fiber is implanted to an artificial scalp portion and to a method for manufacturing the same. In this description, "cap" is similar to a conventional so-called "wig" in appearance, but it is rich in cool feeling and is easily put in the same sense as a cap. In this sense, it is called "cap".

BACKGROUND ART

In usual, a wig is constructed of artificial hair or natural hair and an artificial scalp portion which is used to fix the wig on a human head and also to which the artificial hair is implanted.

Artificial hair has conventionally been made by using a fibrous form such as polyester, rayon, cotton or the like. In the case of a hair wig, the artificial scalp portion is usually formed into a network body by using nylon. In the case of a hairpiece, the scalp portion is formed into the same network structure or is into a rhombic shape by the sewing in order to give it stretchability. Also, there has been recently used a flexible thin-film like scalp portion made of synthetic resin so that it can be fixed to a human head using a snap system.

Implantation of hairs to the above-mentioned artificial scalp portion is done manually or done by using sewing machines. Further, a method of combining these two techniques is also employed.

Today, most of artificial hairs are made of various kinds of synthetic fibers. The reasons for this include ease of manufacture, low cost, ease in obtaining a desired hair color by coloring, ease in shampoo and care, and unsuitableness of heavy material for artifical hair.

However, all of these types of hair are inferior in thermal conductivity (i.e. coefficient of thermal conductivity is small). As a result, heat of head is hard to dissipate. In combination with evaporation of moisture from the head skin, this causes stuffiness between the head and the artificial scalp portion.

That is, in summer, the artificial hair made of synthetic fibers becomes very hot in case that outside temperature rises or a person who puts on a wig is exposed to direct sunlight. On the other hand, in winter, when a person is in training, with a wig of the artificial hair being put, in a heated room or when a person exercises, under a strong lighting, in for example a stage rehearsal at a theater, the person's head is heated to the extent that it sweats. As a result, the artificial hair made of synthetic fibers which is hard to release heat causes an abnormal increase in the temperature of the head. There are among above-mentioned problems in the artificial hair made of synthetic fibers.

To solve these problems, the present inventor invents a wig wherein a fine thread form is made from single or composited metal powder superior in properties of heat-releasing and moisture-transpiring, and synthetic fibers and the like, and further an artificial scalp portion and artificial hair are made from the fine thread form. The inventor formerly filed a patent application on the base of this invention (Japanese patent application No. 62-109384). Titanium oxide, iron, copper, aluminum, zinc oxide, zirconium and the like are used as the metal powder. The fine thread form is formed in a manner that these metal powder is mixed with or coated onto the synthetic fibers. The artificial scalp portion of the wig is formed in a manner that the fine thread form of the fibers is formed into a network body or a thin film. The artificial hair is formed from single fiber of a predetermined diameter or fibers of very small diameter twisted to the extent that they have a diameter corresponding to that of a hair.

However, even the above-mentioned wig almost loses air permeability among the artificial hair, and heat-releasing effect is lowered when hair care products are applied to the artificial hair. Further, since hair care products are chemicals containing alcohol as a main component, they have serious bad influences upon a wig for example they cause chemical reactions depending on the kind of material of synthetic fibers. Thus, there still remained problems in the selection of the material.

On the other hand, as a head-covering means, there are caps through they are different from wigs in appearance. The caps are superior to wigs in respect of air permeability, but they do not tend to be used very much because they do not satisfy a style that the times desire and persons can not use them in a room in consideration of etiquette.

Further, a manufacturing method of a conventional wig is complicated and is not suitable for mass production. Accordingly it was expensive.

In consideration of the above-mentioned circumstances, an object of the present invention is to provide a wig-like cool cap and a method for manufacturing the same wherein drawbacks in conventional wigs and caps are solved. That is, the object of the invention is to provide a wig-like cool cap which is superior in coolness, is able to be used indoors and outdoors, and further is cheap compared with a conventional wig and a method for manufacturing the same.

DISCLOSURE OF THE INVENTION

A cap of the present invention is constructed in a manner that artificial hair is implanted to an artificial scalp portion and is characterized in that the artificial hair is composed of carbon fiber or fine thread form comprising plural twisted carbon fibers and in that the artificial scalp portion is constructed of a central network portion and an outer surrounding membranous portion. The central network portion is formed from carbon fiber, or fine thread form comprising twisted plural carbon fibers and is constructed in a network. The outer surrounding membranous portion is arranged at an outer circumference of the central network portion and has a plurality of micropores.

The method for manufacturing the cap of the present invention is characterized in that the artificial hair is penetrated through a sieve plate and a cranium-shaped perforated frame, and is brought into contact with a scalp-like net, thereafter the artificial hair is fixed to the scalp-like net. The sieve plate is mesh-like or has many perforations. The cranium-shaped perforated frame has many micropores according to a distribution of hair sprouting at a head. The scalp-like net is arranged at another side of the craunim-shaped perforated from.

BEST MODE FOR CARRYING OUT THE INVENTION

A wig-like cool cap and a method for manufacturing the same of the present invention are explained in detail below.

A wig-like cool cap of the present invention is formed in a manner that artificial hair is implanted to an artificial scalp portion. Carbon fiber superior in thermal conductivity, preferably mixed fiber of the carbon fiber and hemp fiber superior in moisture-transpiring characteristic, are applied to a part of the artificial hair and the artificial scalp portion.

As the carbon fiber, single form of suitable diameter may be used or a fine thread form which may be formed (twisted) from carbon fibers having very small diameter may be used. The carbon fiber made from pitch fiber, polyacrylonitrile (PAN) fiber or rayon fiber may be used. Among these carbon fibers, PAN-derived fiber is inferior in gloss because of a pleat at its surface, but it has an advantage that hair care products are easily applied thereto.

To give the carbon fiber an easy coloring characteristic (characteristic to be easily colored) and thermal conductivity, it is preferable that metal such as nickel, copper, zinc oxide, and the like are galvanized onto the carbon fiber by a thickness of about 0.1 to 0.2 μm. By this, the artificial hair or the like is easily colored in desired color without decreasing thermal conductivity of the carbon fiber. Among carbon fibers of various kinds, the PAN-derived fiber has an advantage that galvanizing with metal is easily carried out because of the pleat of it.

In the present invention, the artificial scalp portion is constructed of the central network portion and the outer surrounding membranous portion arranged at an outer circumference of the central network portion.

Figure 1:
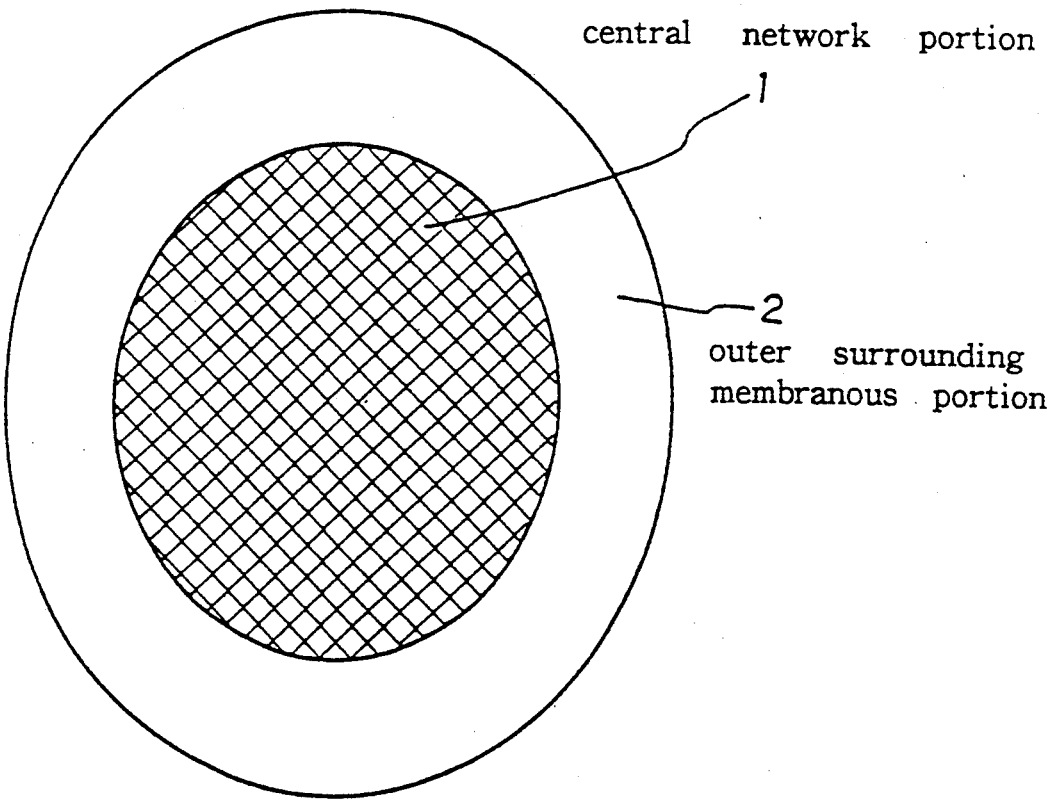
FIG. 1 is an explanatory view explanating an embodiment of an artificial scalp portion of a wig-like cool cap of the present invention.

An example of relationship between the central network portion (1) and the outer surrounding membranous portion (2) is shown in FIG. 1. A shape and a size of the artificial scalp portion are suitably selected according to those of a human head, and an artificial scalp portion of a cap of the present invention is not limited to that shown in FIG. 1.

The central network portion (1) is formed from carbon fiber or fine thread form of twisted plural carbon fibers and is constructed in a network. As carbon fibers, the same material as is used in the artificial hair can be used, and if desired, hemp fiber superior in moisture-transpiring characteristic may be used in a part of the artificial hair and the artificial scalp portion or galvanizing with metal may be carried out in order to prevent stuffiness between a human head and the artificial scalp portion.

At the outer circumference of the central network portion (1) is arranged the outer surrounding membranous portion (2) facilitating the mounting of the cap to a head. Many micropores are formed on the outer surrounding membranous portion (2) to evaporate sweat and moisture outwardly. Though a diameter of the micropores is not specifically limited, about 1 to 2 μm diameter is standard. A compound reinforcement of nylon and polyeurethane (for example a compound reinforcement wherein polyerurethane is coated onto nylon fiber) or the like can be suitably used for the outer surrounding membranous portion (2). As a method for forming micropores on the membranous portion, there can be used a method wherein the micropores are formed with a needle being penetrated through the membranous portion after the portion is produced, a dissolving method wherein water soluble organic or inorganic solid particles are previously blended in material from which the membranous portion is formed and the solid particles are dissolved after the membranous portion is formed, and the like. However, usable method is not limited to those. The so-called stuffiness can be effectively prevented to obtain a cool feeling by transpiring outwardly sweat and water vapour occurring between a scalp and the artificial scalp portion by virtue of the micropores formed on the artificial scalp portion.

As a method for implanting the artificial hair to the artifical scalp portion, there can be employed conventional methods such as a manual method, a method with a sewing machine, and the like. However, according to the method described below, it is possible to manufacture many wig-like cool caps very cheaply.

Figure 4:
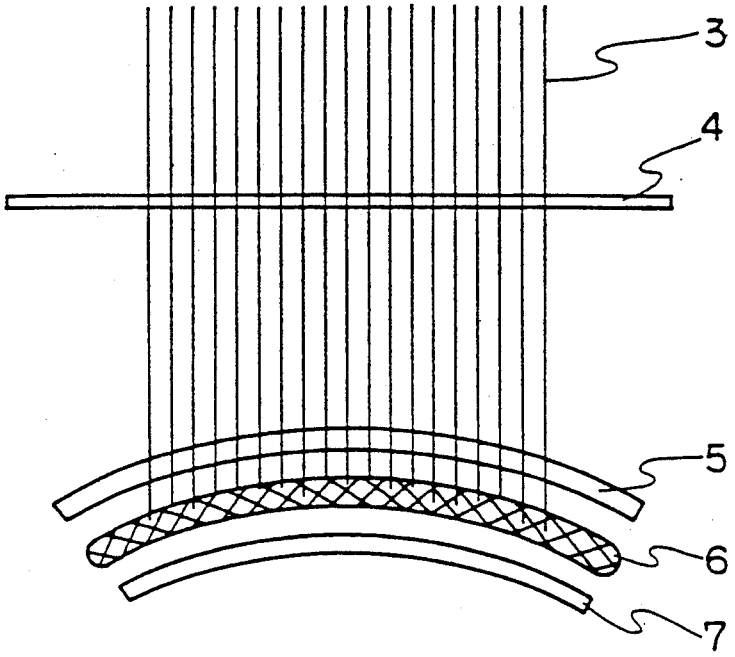
FIG. 4 is a schematic explanatory view explaining an embodiment of a method for manufacturing a wig-like cool cap of the present invention.
Figure 5:
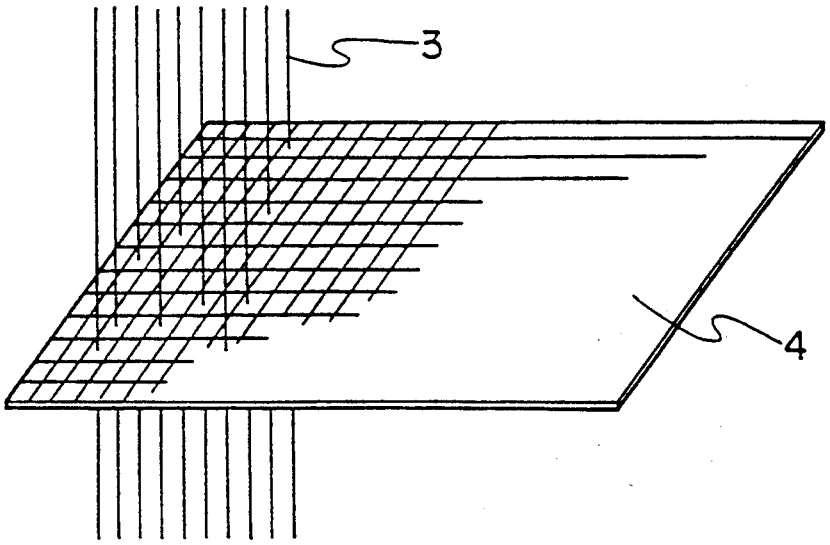
FIG. 5 is a schematic perspective view showing the sieve plate portion of FIG. 4.

That is, as shown in FIGS. 4 to 5, previously formed artificial hair (3) is penetrated through a sieve plate (4) which is mesh-like or has many perforations, and furhter is penetrated through a cranium-shaped perforated frame (5) having many micropores formed according to a distribution of hair at a head. At another side of the perforated frame (5) (such side that is reverse to a side from which the artifical hair is inserted), a scalp-like net (the central network portion) (6) is previously positioned, thereafter the artificial hair which comes through the perforated frame (5) is brought into contact with the scalp-like net (6). The artificial hair (3) is fixed to the scalp-like net (6) by adhesion with adhesive or welding so that, in use, the artificial hair does not fall out. At this operation, it is preferable that fixing of the artificial hair is carried out in a manner that the scalp-like net (6) is interposed, with being firmly pressed, between a press frame (7) and the perforated frame (5).

After the adhesion or the welding is completed and drying for a predetermined period is carried out, many permeable pores are formed all over the scalp-like net (6) in order to improve air permeability in use. The permeable pores are distributed similarly to a distribution of sweat gland and sebaceous gland at a human scalp or are distributed more than its distribution.

It is preferable that each kind of hair color similar to hair of an user (e.g. marbled color) is provided and the artificial hair is formed so as to resemble the hair color of each users.

It is preferable that hair fiber has such surface structure that each user can freely tone the artificial hair by hair coloring after putting it on. It is possible to give this easy coloring characteristics to the hair fiber by galvanizing with metal such as nickel, copper and the like onto the carbon fiber.

Next, examples of experiments confirming superior heat-releasing characteristic of carbon fiber are shown.

Figure 2:
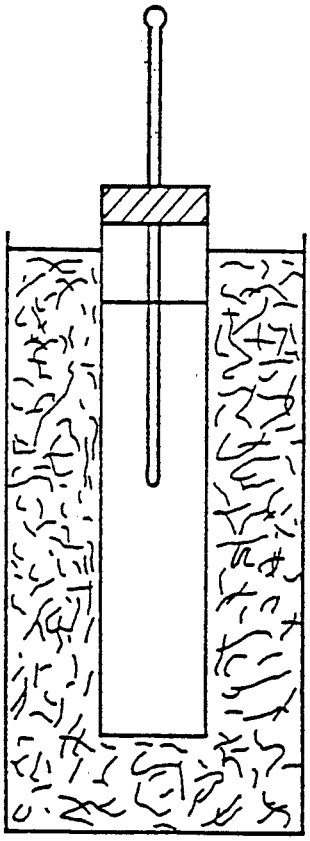
FIG. 2 is a schematic explanatory view showing an apparatus used in an experiment confirming a heat-releasing characteristic of carbon fiber.

20 ml of hot water was introduced into a test tube having a diameter (an inner diameter) of 15 mm and a length of 130 mm. Thereafter, the test tube was tight sealed maintaining a temperature of not less than 80° C. This test tube was introduced into a can (45 mm $\phi \times 110$ mm, a can galvanized with Fe-Sn) filled with test material as shown in FIG. 2, thereafter this was set in a thermostat insulated to be 13° C. A distance between the test tube and a wall or a bottom of the can was kept at 15 mm. Time period for water temperature to fall from 80° C. to 30° was measured by a stop watch. The water temperature was measured by a mercury-in-glass thermometer.

Figure 3:
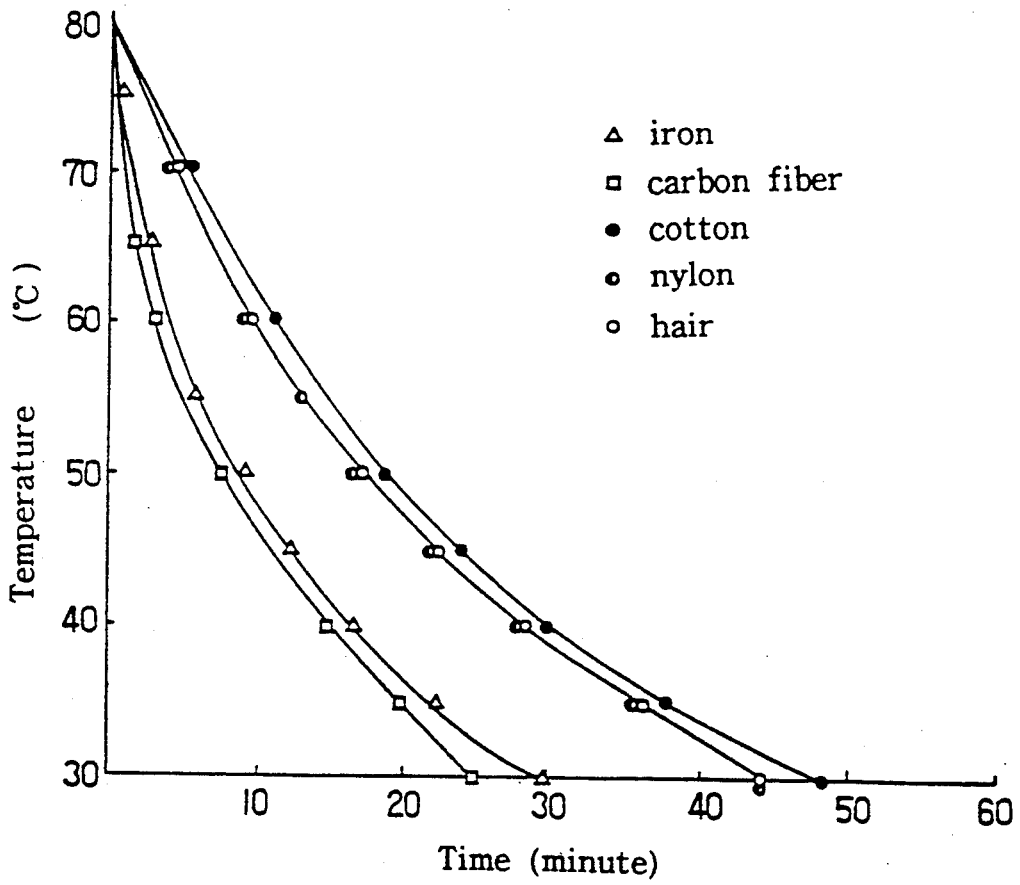
FIG. 3 is a graph showing a result of the experiment carried out with the apparatus shown in FIG. 2.

Result of the measurement is shown in Table 1 and FIG. 3. From Table 1 and FIG. 3, it is found that carbon fiber has excellently superior heat-releasing characteristic.

TABLE 1

| | Temperature (°C.) | | | | | | | | | | |
|---|---|---|---|---|---|---|---|---|---|---|---|
| | 80 | 75 | 70 | 65 | 60 | 55 | 50 | 45 | 40 | 35 | 30 |
| iron | 0 | 36" | — | 2'50" | — | 5'42" | 9'15" | 12'28" | 16'41" | 22'31" | 30'01" |
| cotton | 0 | — | 5'14" | — | 11'06" | — | 18'44" | 23'50" | 29'57" | 37'47" | 48'27" |
| hair | 0 | — | 4'30" | — | 9'30" | — | 17'05" | 22'30" | 28'30" | 36'20" | 44'10" |
| nylon | 0 | — | 3'30" | — | 9'00" | 13'00" | 16'30" | 21'40" | 28'00" | 35'30" | 44'00" |
| CF* | 0 | — | — | 1'30" | 3'02" | — | 7'31" | — | 15'00" | 20'00" | 25'00" |

*carbon fiber

Fifty adults (thirty eight males and twelve females) put a cap of the present invention and a conventional wig, and a sensuous test about heat-releasing characteristic (cool feeling) was carried out. Specification of a cap (wig) used in the test is shown in Table 2.

TABLE 2

| | | Test Sample | Comparative Sample |
|---|---|---|---|
| Artificial Scalp Portion | Central Network Portion | carbon fiber 10 mesh | nylon 10 mesh |
| | Outer Surrounding Portion | compound reinforcement of nylon and polyeurethane (Polyurethane is coated onto nylon fiber) | Polyvinyl chloride |
| Hair | Implanted Portion | carbon fiber (65 μm $\phi$, 50 mm) | nylon (65 μm $\phi$, 50 mm) |
| | Implantation Density | 250 hairs/cm$^2$ | 250 hairs/cm$^2$ |

Test subject are scholars or office workers including from teen-ager to fifty-ager. They are classified into two groups of A and B according to their hair density. Group A includes persons having very thin hair whose hair density is not more than 10 hairs/cm$^2$. Group B includes persons having thin hair whose hair density is 10~100 hairs/cm$^2$.

Persons subjected this test appraise the cap of the present invention in comparison with conventional products (the Comparative Sample, refer to Table 2) according to the standard as below.

Standard of appraisal a: feel coolness (there is a cool feeling)
b: feel coolness slightly
c: don't feel stuffiness but don't feel coolness, too
d: don't feel difference from conventional products (feel stuffiness)
e: feel stuffiness not less than d Result of the test is shown in Table 3.

TABLE 3

| | | distribution by age | | | | | | | | |
|---|---|---|---|---|---|---|---|---|---|---|
| | | teens-twenties | | | thirties | | | fourties | | |
| | | distribution by sex | | | | | | | | |
| Hair Density | appraisal | male | female | subtotal | male | female | subtotal | male | female | subtotal |
| A | a | | | | 1 | 0 | 1 | 0 | 0 | 0 |
| not more than | b | | | | 7 | 1 | 8 | 6 | 2 | 8 |
| 10 hairs/cm$^2$ | c | | | | 0 | 1 | 1 | 2 | 0 | 2 |
| | d | | | | 0 | 0 | 0 | 0 | 0 | 0 |
| | e | | | | 0 | 0 | 0 | 0 | 0 | 0 |
| | subtotal | | | | 8 | 2 | 10 | 8 | 2 | 10 |
| B | a | 1 | 0 | 1 | 1 | 0 | 1 | 1 | 0 | 1 |
| not more than | b | 3 | 0 | 3 | 2 | 1 | 3 | 3 | 1 | 4 |
| 100 hairs/cm$^2$ | c | 0 | 1 | 1 | 1 | 0 | 1 | 0 | 0 | 0 |
| | d | 0 | 0 | 0 | 0 | 0 | 0 | 0 | 0 | 0 |
| | e | 0 | 0 | 0 | 0 | 0 | 0 | 0 | 0 | 0 |
| | subtotal | 4 | 1 | 5 | 4 | 1 | 5 | 4 | 1 | 5 |
| | a | 1 | 0 | 1 | 2 | 0 | 2 | 1 | 0 | 1 |
| | b | 3 | 0 | 3 | 9 | 2 | 11 | 9 | 3 | 12 |
| | c | 0 | 1 | 1 | 1 | 1 | 2 | 2 | 0 | 2 |
| | d | 0 | 0 | 0 | 0 | 0 | 0 | 0 | 0 | 0 |
| | e | 0 | 0 | 0 | 0 | 0 | 0 | 0 | 0 | 0 |
| total | | 4 | 1 | 5 | 12 | 3 | 15 | 12 | 3 | 15 |

| | distribution by age | |
|---|---|---|
| | fifties and more | total (number of person) |
| | distribution by sex | |

TABLE 3-continued

| Hair Density | appraisal | male | female | subtotal | male | female | subtotal | rate (%) |
|---|---|---|---|---|---|---|---|---|
| A | a | 2 | 1 | 3 | 3 | 1 | 4 | |
| not more than | b | 5 | 1 | 6 | 18 | 4 | 22 | |
| 10 hairs/cm$^2$ | c | 0 | 1 | 1 | 2 | 2 | 4 | |
| | d | 0 | 0 | 0 | 0 | 0 | 0 | |
| | e | 0 | 0 | 0 | 0 | 0 | 0 | |
| | subtotal | 7 | 3 | 10 | 23 | 7 | 30 | |
| B | a | 1 | 0 | 1 | 4 | 0 | 4 | |
| not more than | b | 1 | 1 | 2 | 9 | 3 | 12 | |
| 100 hairs/cm$^2$ | c | 1 | 1 | 2 | 2 | 2 | 4 | |
| | d | 0 | 0 | 0 | 0 | 0 | 0 | |
| | e | 0 | 0 | 0 | 0 | 0 | 0 | |
| | subtotal | 3 | 2 | 5 | 15 | 5 | 20 | |
| | a | 3 | 1 | 4 | 7 | 1 | 8 | 16 |
| | b | 6 | 2 | 8 | 27 | 7 | 34 | 68 |
| | c | 1 | 2 | 3 | 4 | 4 | 8 | 16 |
| | d | 0 | 0 | 0 | 0 | 0 | 0 | 0 |
| | e | 0 | 0 | 0 | 0 | 0 | 0 | 0 |
| total | | 10 | 5 | 15 | 38 | 12 | 50 | 100% |

As is clear from Table 3, almost all persons over whole age group appreciate that a cap of the present invention gives coolness. Further, nobody feels stuffiness as felt in a conventional wig.

As explained above, according to a wig-like cool cap of the present invention, the excellent coolness which has not been felt can be achieved, because in a cap of the present invention is used carbon fiber material having very large coefficient of thermal conductivity compared with the material used in a conventional wig such as synthetic fiber, thereby superior heat-releasing characteristic can be obtained, and stuffiness and sweat peculiar to conventional wigs can be effectively prevented. Further, carbon fiber can be suitably used for a cap to which hair care products and coloring reagent are necessary because of its superior resistance against chemicals. Carbon fiber also has an advantage that it is most suitable for a cap used on a human head because of its very small specific gravity.

As described above, one can continue to use a cap of the present invention under any surrounding condition irrespective of season and inside or outside of a door. That is, a cap of the present invention gives users an epoch-making convenience.

Moreover, many wigs can be manufactured cheaply by a method for manufacturing a wig-like cool cap of the present invention.

INDUSTRIAL APPLICABILITY

As described above, a cap of the present invention is useful for a wig put on indoors and outdoors, further a method for manufacturing of the present invention is excellently suitable for mass production of wigs.

I claim:

1. A wig-like cool cap wherein artificial hair is implanted into an artificial scalp portion wherein the artificial hair is selected from the group consisting of carbon fiber and a fine thread form comprising twisted plural carbon fibers, and that the artificial scalp portion comprises a central network portion and an outer surrounding membranous portion, the central network portion being composed of a material selected from the group consisting of carbon fiber and fine thread form comprising twisted plural carbon fibers and being constructed in a network, and the outer surrounding membranous portion being arranged at an outer circumference of the central network portion and having a plurality of micropores.

2. A wig-like cool cap according to claim 1 wherein hemp fiber is mixed into the carbon fiber.

3. A wig-like cool cap according to claim 1 wherein metal-galvanizing is applied to a surface of the carbon fiber.

4. A wig-like cool cap according to claim 3 wherein the metal-galvanizing is carried out with nickel.

5. A wig-like cool cap according to claim 3 wherein the metal-galvanizing is carried out with zinc.

6. A wig-like cool cap according to claim 3 wherein the metal-galvanizing is carried out with copper.

7. A method for manufacturing a wig-like cool cap comprising:

a) forming a central network of fibres selected from the group consisting of carbon fibre, twisted plural carbon fibres and carbon fibres coated with a metal;

b) attaching said central network to a porous outer circumferential portion formed of a different fibrous material;

c) penetrating artificial hair selected from the group consisting of carbon fibre, twisted, small diameter carbon fibres and mixed fibres of carbon fibre and hemp through a sieve plate and then through a cranium-shaped perforated frame on the reverse side of which has been positioned said central network of fibres; and d) affixing said artificial hair to said central network of fibres.

* * * * *